US011180909B2

(12) United States Patent
Brockmeyer

(10) Patent No.: US 11,180,909 B2
(45) Date of Patent: Nov. 23, 2021

(54) FLOATING SINK

(71) Applicant: Michael Brockmeyer, Grand Forks, ND (US)

(72) Inventor: Michael Brockmeyer, Grand Forks, ND (US)

( * ) Notice: Subject to any disclaimer, the term of this patent is extended or adjusted under 35 U.S.C. 154(b) by 169 days.

(21) Appl. No.: 16/750,483

(22) Filed: Jan. 23, 2020

(65) Prior Publication Data

US 2020/0232199 A1 Jul. 23, 2020

Related U.S. Application Data

(60) Provisional application No. 62/795,601, filed on Jan. 23, 2019.

(51) Int. Cl.
*E03C 1/324* (2006.01)
*E03C 1/24* (2006.01)
*E03C 1/182* (2006.01)

(52) U.S. Cl.
CPC ..... *E03C 1/324* (2013.01); *E03C 1/182* (2013.01); *E03C 1/24* (2013.01)

(58) Field of Classification Search
CPC . E03C 1/18; E03C 1/182; E03C 1/324; E03C 1/24; E03C 1/322
USPC ..... 4/645
See application file for complete search history.

(56) References Cited

U.S. PATENT DOCUMENTS 5,179,740 A * 1/1993 Marsilio ..... E03C 1/24 4/651
7,490,375 B2 * 2/2009 Luk ..... E03C 1/264 210/238
9,157,223 B2 * 10/2015 Kempen ..... E03C 1/24
10,934,694 B1 * 3/2021 Porter ..... E03B 9/20
2015/0074900 A1 * 3/2015 Aykens ..... E03C 1/186 4/650

(Continued)

FOREIGN PATENT DOCUMENTS

DE 102011010291 A 8/2012
DE 202011110049 U 10/2012
EP 3524742 A1 * 8/2019 ..... E03C 1/324

OTHER PUBLICATIONS

"Enchanting Trough Sink With Towel Hooks And Cream Wall," Ewindandsolar, (Aug. 14, 2017), available at <http://www.rockytopsinc.com/commercial>.

(Continued)

*Primary Examiner* — Christine J Skubinna
(74) *Attorney, Agent, or Firm* — Danielson Legal LLC

(57) ABSTRACT

Methods and systems for installing a floating sink. The systems may comprise a sink, the sink having an integrated bracket configured to attach to a wall and two spring assisted fasteners configured to attach the sink to the wall through the integrated bracket. Systems may include a drain plate integrated into a base of the sink, a drain pan configured to be attached to a drain pipe, and an attachment mechanism configured to temporarily attach the drain pan to the drain plate, wherein the drain pan can be connected and disconnected from the drain pan at the attachment mechanism. Systems may include an overflow assembly for the sink, including an overflow backplate attached to a backside of the ramp sink, an overflow collar attached to a drain pipe, and tubing connecting the overflow backplate to the overflow collar.

3 Claims, 7 Drawing Sheets

| | |
|---|---|
| 201 | Drain Plate |
| 202 | Drain Studs |
| 206 | Drain Pan |
| 208 | Acorn Nuts |

(56) References Cited

U.S. PATENT DOCUMENTS

2021/0015307 A1* 1/2021 Oberholzer ..... A47K 1/04

OTHER PUBLICATIONS

"Ramp Style Bathroom Sinks @PM05," Roccomunity, (Jan. 25, 2015), available at <https://roccommunitysummit.org/ramp-style-bathroom-sinks-pm05.hta>.
"60" ADA Floating Concrete Ramp Sink," Trueform available at <https://www.trueformconcrete.com/60-ada-floating-concrete-ramp-sink/>.

* cited by examiner

| | |
|---|---|
| 100 | Sink |
| 105 | Ledge |
| 110 | Basin |
| 115 | Lip |
| 120 | Drain Assembly |
| 121 | Overflow Assembly |
| 122 | Integrated Bracket |
| 123 | Overflow |
| 130 | Keyhole Openings |
| 135 | Other Openings |
| 140 | Detachable Pan |
| 150 | Drain |

| | |
|---|---|
| 201 | Drain Plate |
| 202 | Drain Studs |
| 206 | Drain Pan |
| 207 | Drain O-ring |
| 208 | Acorn Nuts |

| | |
|---|---|
| 201 | Drain Plate |
| 202 | Drain Studs |
| 206 | Drain Pan |
| 208 | Acorn Nuts |

| | |
|---|---|
| 306 | PVC Overflow Collar |
| 307 | PVC Overflow Backplate |
| 308 | Overflow O-ring |
| 309 | Nylon Barbed Elbow |
| 310 | Vinyl Tube |

| | | |
|---|---|---|
| 306 | PVC | Overflow Collar |
| 307 | PVC | Overflow Backplate |
| 309 | Nylon | Barbed Elbow |
| 310 | Vinyl | Tube |
| 318 | Rubber | Gasket |
| 319 | Drain | Locknut |

FIG. 4A
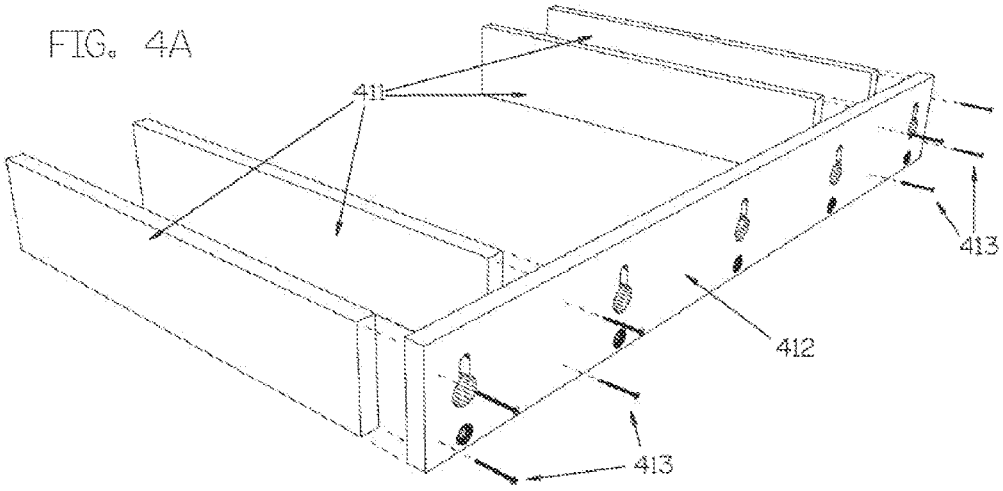
FIG. 4B
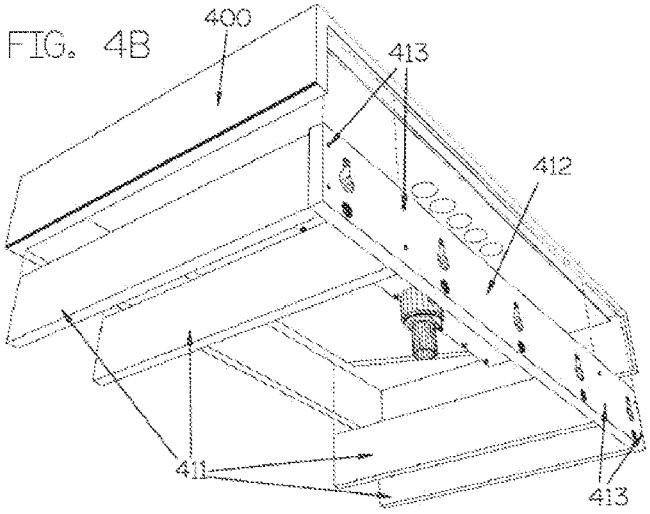
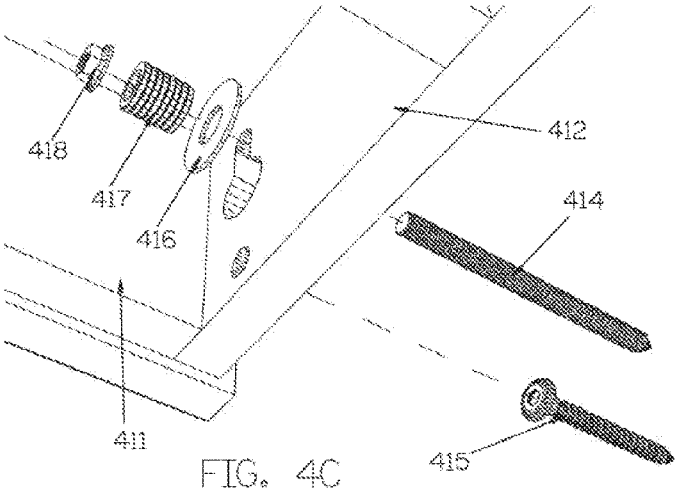
FIG. 4C
| | |
|---|---|
| 400 | Sink |
| 411 | Ribs |
| 412 | Spine with Optional Keyholes |
| 413 | Screws |
| 414 | Hanger Bolt |
| 415 | Lag Screw |
| 416 | Washer |
| 417 | Spring |
| 418 | Flange Nut |

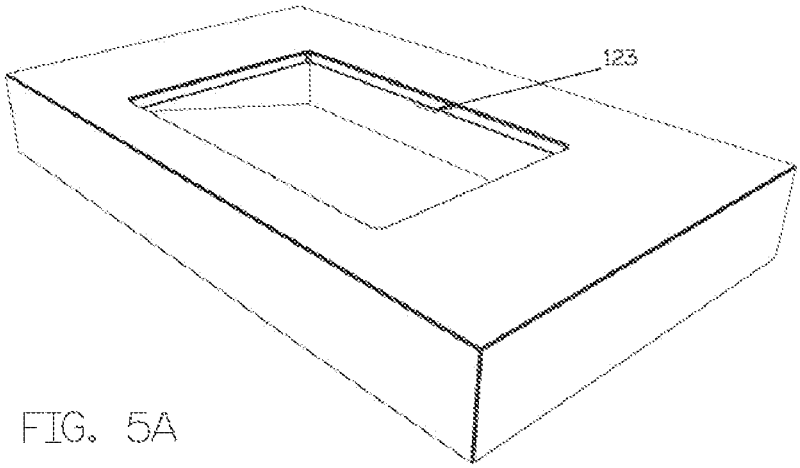
FIG. 5A
FIG. 5B
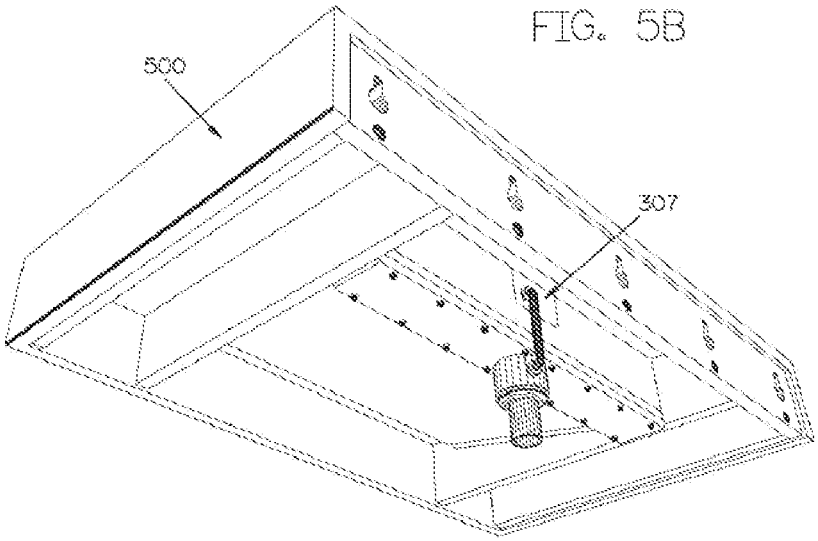
| | |
|---|---|
| 123 | Overflow Slot |
| 307 | PVC Overflow Backplate |
| 500 | Sink |

FLOATING SINK

CROSS-REFERENCE TO RELATED APPLICATIONS

The present application claims the benefit of and priority to U.S. provisional application No. 62/795,601, filed on Jan. 23, 2019, the entire disclosure of which is hereby incorporated by reference as if set forth in its entirety herein.

TECHNICAL FIELD

Embodiments described herein relate to methods and systems for installing a floating sink and, more particularly but not exclusively, to methods and systems for installing a floating sink with an integrated bracket, a detachable drain plate, and detachable overflow assembly.

BACKGROUND

Wall mounted and floating sinks have become prevalent home fixtures. The sinks may be manufactured from porcelain, concrete, granite, quartz, and other materials. Typically, to install a wall mount sink, a bracket must first be installed in the wall and the wall board may be removed for this installation. This installation can be costly and difficult, oftentimes requiring a professional contractor for installation.

The installation often uses solid fasteners to attach the sink to the wall. Solid fasteners are strong, but do not provide forgiveness in the event of settling. If settling in occurs with a solid fastener, the sink may need to be removed and re-installed with a tighter fastener.

Once a sink is installed, if a clog were to develop in an overflow or in the drain pan, the sink may need to be removed for repair. For existing sink structures, individual features of a sink, such as a drain pan or an overflow assembly, are not removable from the body of the sink. A need exists, therefore, for systems and methods that overcome these disadvantages of existing techniques for sink installation and repair.

SUMMARY

This summary is provided to introduce a selection of concepts in a simplified form that are further described below in the Detailed Description section. This summary is not intended to identify or exclude key features or essential features of the claimed subject matter, nor is it intended to be used as an aid in determining the scope of the claimed subject matter.

In one aspect, embodiments relate to a sink installation system. The system includes a sink, the sink having an integrated bracket configured to attach to a wall; a first spring assisted fastener comprising a first spring and a first hanger bolt; and a second spring assisted fastener comprising a second spring and a second hanger bolt, wherein the first and second spring assisted fasteners are configured to attach the sink to the wall through the integrated bracket.

In some embodiments, the sink installation system further includes at least one lag screw configured to attach the sink to the wall through the integrated bracket.

In some embodiments, the integrated bracket includes a plurality of fastener openings and at least one lag screw opening, wherein the fastener openings are sized to allow the first hanger bolt and the second hanger bolt to extend through the fastener openings, and the at least one lag screw opening is below the fastener openings.

In some embodiments, the sink of the sink installation system is made of at least one of porcelain, concrete, granite, solid surface, and quartz.

In some embodiments, the sink installation system further includes a drain assembly system for the sink and the assembly system includes a drain plate integrated into a base of the sink; a drain pan, configured to be attached to a drain pipe; and an attachment mechanism configured to temporarily attach the drain pan to the drain plate, wherein the drain pan can be connected and disconnected from the drain plate at the attachment mechanism.

In some embodiments, the sink installation system includes a ramp sink.

In some embodiments, the sink installation system further includes an overflow assembly and the overflow assembly includes an overflow backplate attached to a backside of the ramp sink, the overflow backplate having a hole; an overflow collar attached to a drain pipe; and tubing, the tubing having a first end and a second end, wherein the tubing is attached at the first end to the overflow backplate at the hole and at the second end to the overflow collar, such that water from the sink may drain from the hole in the backplate through the tubing and into the drain pipe. In some embodiments, the sink installation system further includes a drain assembly system for the sink and the assembly system includes a drain plate integrated into a base of the sink; a drain pan, configured to be attached to a drain pipe; and an attachment mechanism configured to temporarily attach the drain pan to the drain plate, wherein the drain pan can be connected and disconnected from the drain plate at the attachment mechanism.

In another aspect, embodiments relate to a method of installing the sink installation system. The method includes placing the first spring of the first spring assisted fastener at a first opening of the integrated bracket; threading the first hanger bolt of the first spring assisted fastener through the first opening of the integrated bracket and through the first spring; attaching the first spring to the first hanger bolt; and attaching the first hanger bolt of the first spring assisted fastener to the wall, such that the sink is affixed to the wall at the first spring assisted fastener.

In some embodiments, the method further includes attaching at least one lag screw under the first hanger bolt. In some embodiments, the method further includes placing the spring of the second spring assisted fastener at a second opening of the integrated bracket; threading the second hanger bolt of the second spring assisted fastener through the second opening of the integrated bracket and through the second spring; attaching the second spring to the second hanger bolt; and attaching the second hanger bolt of the second spring assisted fastener to the wall, such that the sink is affixed to the wall at the first spring assisted fastener and second spring assisted fastener.

In some embodiments, the method further includes installing a removable drain pan, including integrating an attachment mechanism into a drain plate of the sink; and attaching the removable drain pan to the drain plate at the attachment mechanism.

In another aspect, embodiments relate to a drain assembly system for a sink. The drain assembly comprises a drain plate integrated into a base of the sink; a drain pan, configured to be attached to a drain pipe; and an attachment mechanism configured to temporarily attach the drain pan to the drain plate, wherein the drain pan can be connected and disconnected from the drain plate at the attachment mechanism.

In some embodiments, the drain assembly system includes a ramp sink. In some embodiments, the drain plate is located towards the back of the sink. In some embodiments, the length of the drain plate is equal to the width of the sink.

In some embodiments, the system further includes an overflow assembly. The overflow assembly includes an overflow backplate attached to a backside of the ramp sink, the overflow backplate having a hole; an overflow collar attached to the drain pipe; and tubing, the tubing having a first end and a second end, wherein the tubing is attached at the first end to the overflow backplate at the hole and at the second end to the overflow collar, such that water from the sink may drain from the hole in the backplate through the tubing and into the drain pipe. In some embodiments, the overflow collar is configured to attach to a pipe extending through the drain pan.

In another aspect, embodiments relate to a method of inspecting the drain assembly system. The method includes detaching the drain pan from the drain plate at the attachment mechanism integrated into the drain plate; inspecting the drain pan; and attaching the drain pan to the drain plate at the attachment mechanism.

In yet another aspect, embodiments relate to an overflow assembly for a ramp sink. The overflow assembly includes an overflow backplate attached to a backside of the ramp sink, the overflow backplate having a hole; an overflow collar attached to a drain pipe; and tubing, the tubing having a first end and a second end, wherein the tubing is attached at the first end to the overflow backplate at the hole and at the second end to the overflow collar, such that water from the sink may drain from the hole in the backplate through the tubing and into the drain pipe.

BRIEF DESCRIPTION OF DRAWINGS

Non-limiting and non-exhaustive embodiments of this disclosure are described with reference to the following figures, wherein like reference numerals refer to like parts throughout the various views unless otherwise specified.

FIG. 4A-C illustrate a mounting assembly system in accordance with one embodiment;

FIG. 5A-B illustrate an overflow cavity in accordance with one embodiment;

DETAILED DESCRIPTION

Various embodiments are described more fully below with reference to the accompanying drawings, which form a part hereof, and which show specific exemplary embodiments. However, the concepts of the present disclosure may be implemented in many different forms and should not be construed as limited to the embodiments set forth herein; rather, these embodiments are provided as part of a thorough and complete disclosure, to fully convey the scope of the concepts, techniques and implementations of the present disclosure to those skilled in the art. Embodiments may be practiced as methods, systems or devices. Accordingly, embodiments may take the form of a hardware implementation, an entirely software implementation or an implementation combining software and hardware aspects. The following detailed description is, therefore, not to be taken in a limiting sense.

Reference in the specification to "one embodiment" or to "an embodiment" means that a particular feature, structure, or characteristic described in connection with the embodiments is included in at least one example implementation or technique in accordance with the present disclosure. The appearances of the phrase "in one embodiment" in various places in the specification are not necessarily all referring to the same embodiment. The appearances of the phrase "in some embodiments" in various places in the specification are not necessarily all referring to the same embodiments.

In addition, the language used in the specification has been principally selected for readability and instructional purposes and may not have been selected to delineate or circumscribe the disclosed subject matter. Accordingly, the present disclosure is intended to be illustrative, and not limiting, of the scope of the concepts discussed herein.

As discussed previously, wall mounted and floating sinks have become prevalent home fixtures, but the installation process can be difficult. If a sink is not installed well, settling can cause the fixture to be mounted crooked. Furthermore, a floating sink often has drainage and overflow systems that are integrated into the sink and, if these systems need to be repaired, the entire sink must be reinstalled. Embodiments described below include removable components, so each component can be individually replaced without uninstalling and reinstalling the sink.

Figure 1A:
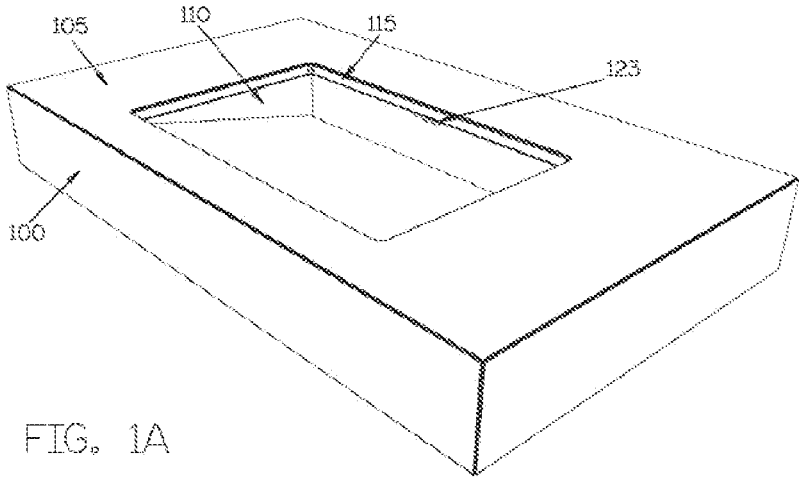
FIG. 1A illustrates a sink in accordance with one embodiment.

FIG. 1A illustrates a sink 100 in accordance with one embodiment. In some embodiments, the sink 100 may include a ledge 105 surrounding a basin 110. The basin 110 may be sloped such that the basin 110 is deepest at the back end of the sink 100 and shallow at the front end of the sink 100. In some embodiments, the basin 110 may include an overflow hole 123 at the back of the sink 100. The overflow hole 123 may be a horizontal slot at the top of the basin 110 and may allow water to drain from the sink 100 through an overflow assembly system described below. The overflow hole 123 may be one inch wide in some embodiments. In some embodiments, the overflow hole 123 may span the length of the basin 110 of the sink 100. In some embodiments, a lip 115 may surround the basin 110 and may attach the basin 110 to the sink ledge 105.

In some embodiments, the sink 100 may be made of at least one of porcelain, concrete, granite, quartz, solid surface, or any combination thereof. The sink 100 may be attached to a wall or may be attached to or rest on a cabinet structure in some embodiments.

Figure 1B:
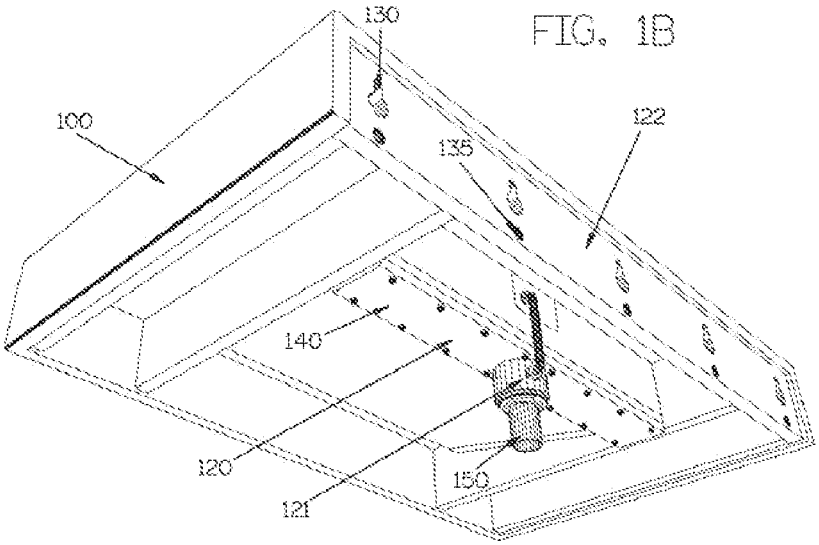
FIG. 1B illustrates an installation system in accordance with one embodiment.

FIG. 1B illustrates an installation system in accordance with one embodiment. In some embodiments, the sink 100 may have an integrated bracket 122, a drain assembly system 120, and an overflow assembly system 121. The integrated bracket 122 may have keyhole openings 130 and other openings 135. These openings 130, 135 may facilitate attachment of the sink 100 to a wall. In some embodiments, the drain assembly system 120 may have a detachable plate 140 detachably coupled to the basin 110 of the sink. In some embodiments, if there is a clog in the drain assembly system 120 or the assembly system 120 must be otherwise fixed or cleaned, the detachable plate 140 may be uncoupled from the base of the sink, fixed, and then reattached. In some embodiments, the plate 140 may be reattached with screws, bolts, or other similar fastening devices known to a person having ordinary skill in the art.

In some embodiments, the sink 100 may have an overflow assembly system 121. The overflow assembly system 121 may attach to the drain 150, as described in more detail below. The overflow assembly system may connect to the top of the sink basin and attach to the opening 123 in FIG. 1A. In some embodiments, the water overflow in the sink basin may be directed to the drain 150 through the overflow assembly system 121. The overflow assembly system 121 may be detachably coupled to the sink 100. In some embodiments, to clean or fix the overflow assembly system 121, certain parts may be removed from the system 121, fixed, and then reattached to the sink 100 without having to uninstall and reinstall the sink 100.

Figure 2A:
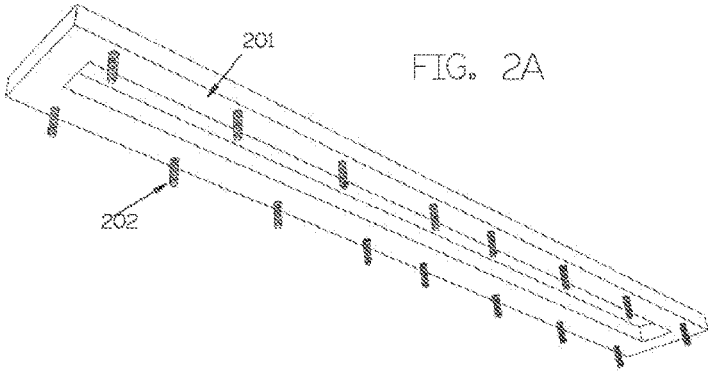
FIG. 2A-D illustrate a drain assembly system in accordance with one embodiment.
Figure 2B:
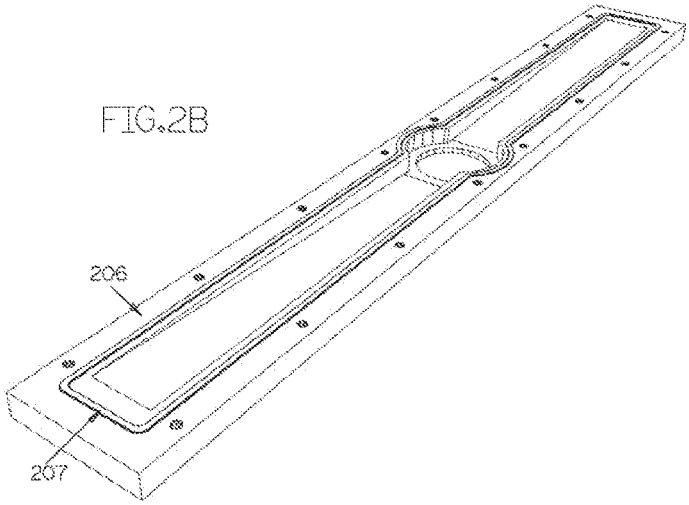
Figure 2C:
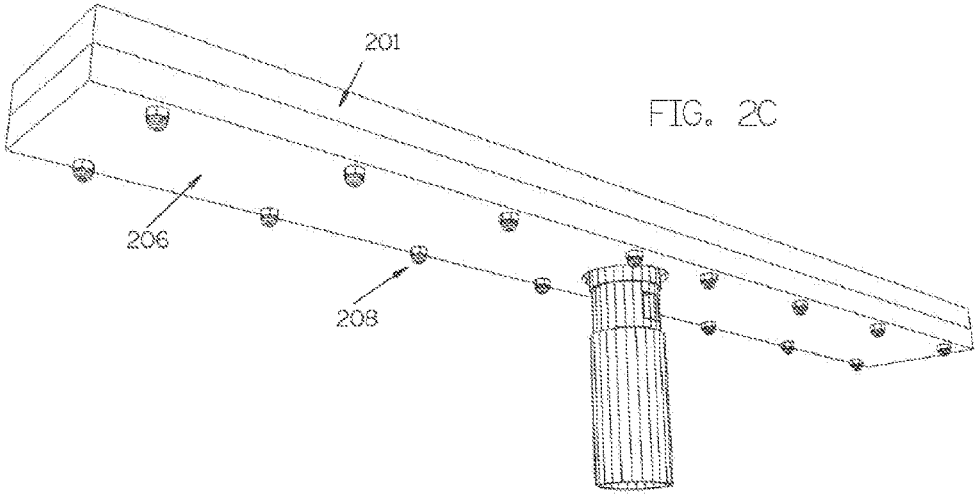

FIG. 2A-D illustrate a drain assembly system in accordance with one embodiment. FIG. 2A illustrates a drain plate 201 with drain studs 202. In some embodiments, the drain plate 201 may be coupled to a sink and a drain pan 206, as shown in FIG. 2B. In some embodiments, the drain plate 201 may be coupled to the drain pan 206 using the mounting studs 202. FIG. 2C illustrates the coupling of the drain plate 201 to the drain pan 206 with drain studs 202 and acorn nuts 208. In some embodiments, the drain pan 206 may be detachably coupled to the drain plate 201.

Figure 2D:
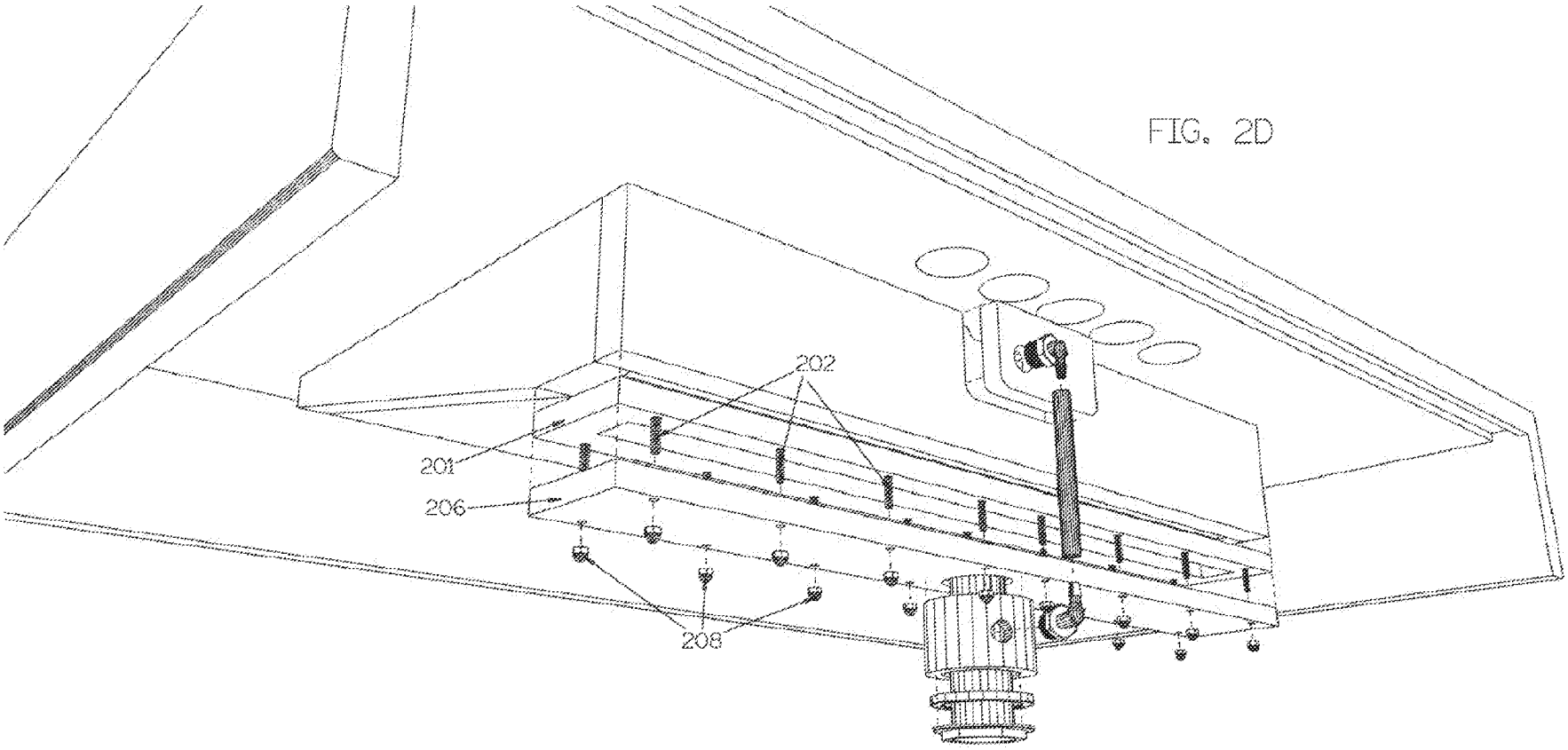
Figure 3A:
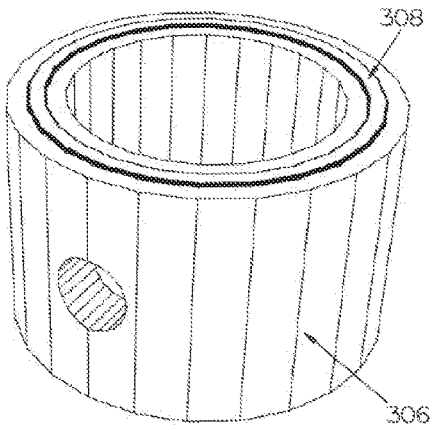
FIG. 3A-E illustrate an overflow assembly system in accordance with one embodiment.
Figure 3B:
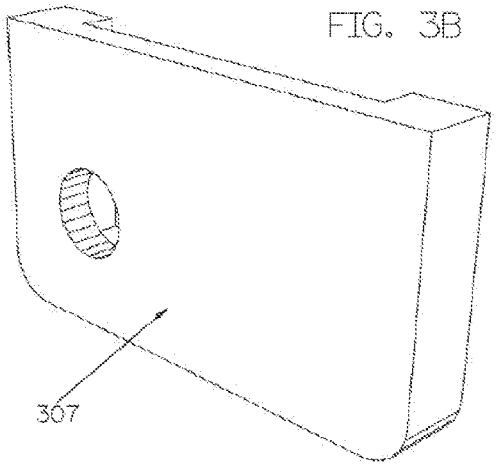
Figure 3C:
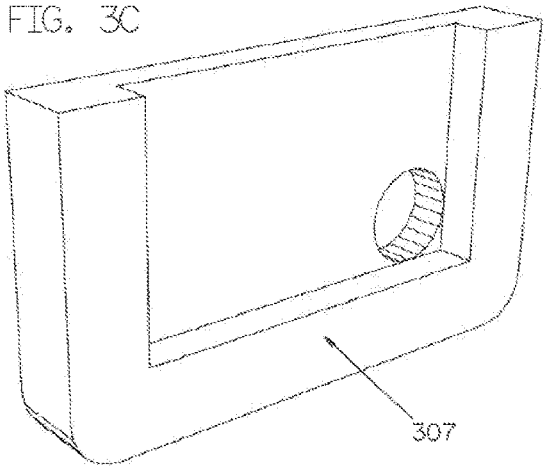
Figure 3D:
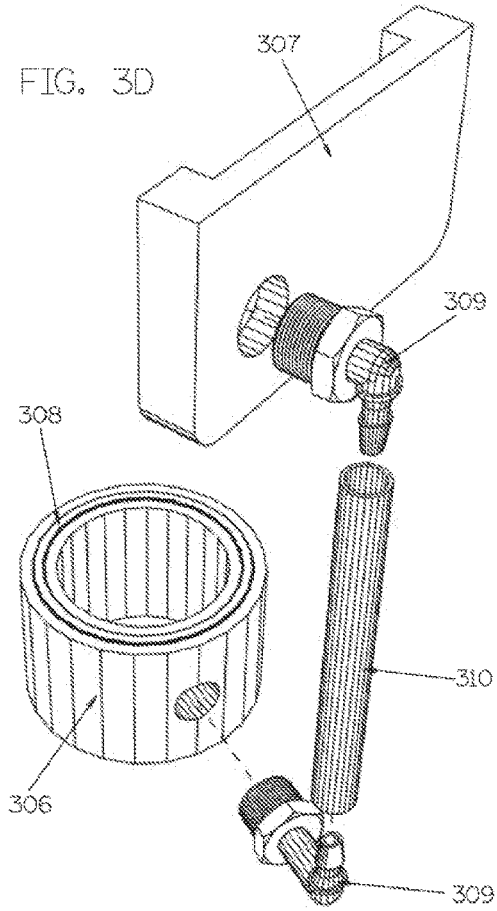
Figure 3E:
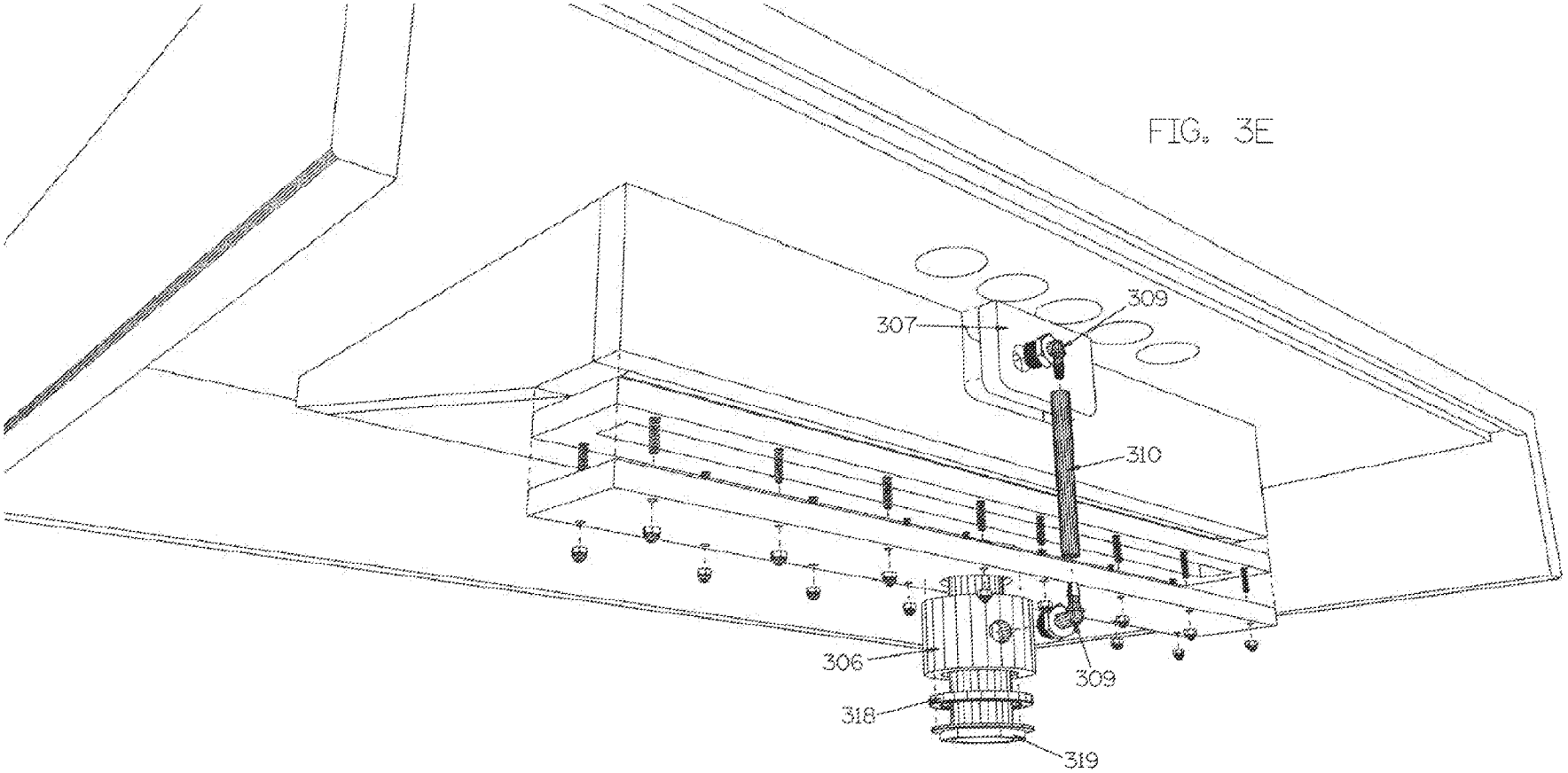

As shown in FIG. 2D, in some embodiments, the drain pan 206 may be coupled to the drain plate 201 in the sink. The drain pan 206 may be removed from the drain plate 201 for cleaning and inspection. In some embodiments, the drain plate 201 may be attached to a drainage system. In some embodiments, the drain assembly may be attached to an overflow assembly in a sink.

FIG. 3A-E illustrate an overflow assembly system in accordance with one embodiment. In some embodiments, the overflow assembly system may include an overflow collar 306 and an overflow O-ring 308. In some embodiments, the overflow collar 306 may be a PVC overflow collar 306 and may circle the overflow O-ring 308. In some embodiments, the overflow collar 306 and overflow O-ring 308 may connect to a tube connected to a sink. In some embodiments, a barbed elbow 309 may be used to connect the PVC overflow collar 306 and the overflow O-ring 308 and a tube 310. In some embodiments, the tube 310 and the elbow 309 may be made of nylon or vinyl.

In some embodiments, the tube 310 may be connected to an overflow backplate 307 with a second barbed elbow 309. In some embodiments, the elbows 309 may screw into the overflow backplate 307 and the overflow collar 306. In some embodiments, the overflow backplate 307 may couple to the sink 300. In some embodiments, the overflow backplate 307 may couple to the top of the underside of the ramp sink 300 at the top of the deepest part of the sink. In some embodiments, the back plate 307 may overlap a slot opening in the sink 300.

In some embodiments, the overflow collar 306 may be attached to the drain. In some embodiments, the drain pipe may be surrounded by a rubber gasket 318 and a drain locknut 319. In some embodiments, the rubber gasket 318 and the drain locknut 319 may be used to keep water from leaking through the bottom of the overflow collar 306.

FIG. 4A-C illustrate a mounting assembly system in accordance with one embodiment. In some embodiments, a mounting assembly may comprise a spine 412 and ribs 411. In some embodiments, the spine 412 and ribs 411 may comprise an integrated bracket. The spine 412 may be an integrated bracket and may be permanently attached to the sink. In some embodiments, the ribs 411 may be perpendicular to the spine 412. Although FIG. 4A shows five keyholes, there may as few as two and as many as ten keyholes in the spine 412 in some embodiments. In some embodiments, the keyholes may be spaced apart the same distance as wall studs. In some embodiments, the ribs 411 may extend across the length of the sink 400.

In some embodiments, a hanger bolt 414 may be threaded through a keyhole in the spine 412 to secure the sink. In some embodiments, the spine 412 may not include keyholes. In some embodiments, the hanger bolt 414 may be secured with a washer 416, a spring 417, and a nut 418. In some embodiments, the nut 418 is a flange nut. In some embodiments, the combination of the spring 417, washer 416, and hanger bolt 414 may be used to adjust the height and level of the sink 400. In some embodiments, a lag screw 415 may be used to further secure the sink 400 to the wall. In some embodiments, the lag screw 415 may be threaded through a different hole than the hanger bolt 414. In some embodiments, screws 413 may be used to secure the sink 400 to the wall through the spine 412.

In some embodiments, the spring 417 may allow some leeway when leveling the sink 400. When the sink 400 settles after being initially attached to the wall through the integrated bracket, the springs 417 may correct settling on one side of the sink 400, such that the sink may remain level and perpendicular to the wall. The hanger bolts 414 threaded through the spine 412 may provide additional support to level the sink 400 after settling.

FIG. 5A-B illustrate an overflow cavity in accordance with one embodiment. In some embodiments, the overflow cavity may include a slot 123 at the top and back of the sink. As shown in FIG. 5B, the backplate 307 may connect to the overflow cavity at the back of the sink 500. In some embodiments, the backplate 307 may connect to a detachable assembly configured to connect to the drain.

The methods, systems, and devices discussed above are examples. Various configurations may omit, substitute, or add various procedures or components as appropriate. For instance, in alternative configurations, the methods may be performed in an order different from that described, and that various steps may be added, omitted, or combined. Also, features described with respect to certain configurations may be combined in various other configurations. Different aspects and elements of the configurations may be combined in a similar manner. Also, technology evolves and, thus, many of the elements are examples and do not limit the scope of the disclosure or claims.

Embodiments of the present disclosure, for example, are described above with reference to block diagrams and/or operational illustrations of methods, systems, and computer program products according to embodiments of the present disclosure. The functions/acts noted in the blocks may occur out of the order as shown in any flowchart. For example, two blocks shown in succession may in fact be executed substantially concurrent or the blocks may sometimes be executed in the reverse order, depending upon the functionality/acts involved. Additionally, or alternatively, not all of the blocks shown in any flowchart need to be performed and/or executed. For example, if a given flowchart has five blocks containing functions/acts, it may be the case that only three of the five blocks are performed and/or executed. In this example, any of the three of the five blocks may be performed and/or executed.

A statement that a value exceeds (or is more than) a first threshold value is equivalent to a statement that the value meets or exceeds a second threshold value that is slightly greater than the first threshold value, e.g., the second threshold value being one value higher than the first threshold value in the resolution of a relevant system. A statement that a value is less than (or is within) a first threshold value is equivalent to a statement that the value is less than or equal to a second threshold value that is slightly lower than the first threshold value, e.g., the second threshold value being one value lower than the first threshold value in the resolution of the relevant system.

Specific details are given in the description to provide a thorough understanding of example configurations (including implementations). However, configurations may be practiced without these specific details. For example, well-known circuits, processes, algorithms, structures, and techniques have been shown without unnecessary detail in order to avoid obscuring the configurations. This description provides example configurations only, and does not limit the scope, applicability, or configurations of the claims. Rather, the preceding description of the configurations will provide those skilled in the art with an enabling description for implementing described techniques. Various changes may be made in the function and arrangement of elements without departing from the spirit or scope of the disclosure.

Having described several example configurations, various modifications, alternative constructions, and equivalents may be used without departing from the spirit of the disclosure. For example, the above elements may be components of a larger system, wherein other rules may take precedence over or otherwise modify the application of various implementations or techniques of the present disclosure. Also, a number of steps may be undertaken before, during, or after the above elements are considered.

Having been provided with the description and illustration of the present application, one skilled in the art may envision variations, modifications, and alternate embodiments falling within the general inventive concept discussed in this application that do not depart from the scope of the following claims.

What is claimed is:

1. A drain assembly system for a ramp sink, the assembly system comprising:

a drain plate integrated into a base of the ramp sink;

a drain pan, configured to be attached to a drain pipe;

an attachment mechanism configured to temporarily attach the drain pan to the drain plate, wherein the drain pan can be connected and disconnected from the drain plate at the attachment mechanism; and an overflow assembly comprising:

an overflow backplate attached to a backside of the ramp sink, the overflow backplate having a hole;

an overflow collar attached to the drain pipe and configured to attach to a pipe extending through the drain pan; and tubing, the tubing having a first end and a second end, wherein the tubing is attached at the first end to the overflow backplate at the hole and at the second end to the overflow collar, such that water from the sink may drain from the hole in the backplate through the tubing and into the drain pipe.

2. The drain assembly system of claim 1, wherein the drain plate is located towards the back of the sink.

3. The drain assembly system of claim 1 wherein the length of the drain plate is equal to the width of the sink.

* * * * *